US005650021A

United States Patent [19]

Takahashi

[11] Patent Number: 5,650,021

[45] Date of Patent: Jul. 22, 1997

[54] METHOD OF PRODUCING SINTERED—OR BOND-RARE EARTH ELEMENT-IRON-BORON MAGNETS

[75] Inventor: Yasunori Takahashi, Tokyo, Japan

[73] Assignees: Kawasaki Teitoku Co., Ltd.; Komeya Inc.; Sanei Kasei Co., Ltd., all of Tokyo, Japan

[21] Appl. No.: 532,539

[22] Filed: Sep. 25, 1995

Related U.S. Application Data

[62] Division of Ser. No. 322,559, Oct. 13, 1994, Pat. No. 5,478,409.

[30] Foreign Application Priority Data

Jan. 12, 1994 [JP] Japan ..... 6-13080

[51] Int. Cl.[6] ..... H01F 1/057

[52] U.S. Cl. ..... 148/104; 148/103; 252/62.54; 419/12

[58] Field of Search ..... 148/101, 103, 148/104; 252/62.54; 419/12, 35

[56] References Cited

U.S. PATENT DOCUMENTS

| | | | |
|---|---|---|---|
| 4,541,877 | 9/1985 | Stadelmaier et al. | 148/101 |
| 4,597,938 | 7/1986 | Matsuura et al. | 148/104 |
| 4,844,751 | 7/1989 | Schultz | 148/105 |

*Primary Examiner*—John Sheehan
*Attorney, Agent, or Firm*—Cushman Darby & Cushman IP Group of Pillsbury Madison & Sutro LLP

[57] ABSTRACT

It is an object of the present invention to provide a method of producing sintered- or bond- rare earth element.iron.boron magnets obtainable easily and superior in magnetic properties with stable performance. The method of producing sintered rare earth element.iron.boron magnets according to the present invention is characterized by that it comprises steps of mixing in a scheduled ratio an acicular iron powder coated with a coating material, a rare earth element powder coated with a coating material and a boron powder coated with a coating material, and subjecting the mixture to compression molding followed by sintering of the molded mixture in the presence of a magnetic field. The method of producing bond rare earth element.iron.boron magnets according to the present invention is characterized by that it comprises steps of preparing a magnet powder by hydrogen-disintegration of the above-mentioned sintered magnet wherein a hydrogen-occluded sintered magnet resulted from heating the magnet under hydrogen atmosphere is subjected to hydrogen emission under substantial vacuum to cause disintegration of the hydrogen-occluded sintered magnet, coating the magnet powder with a coating material, mixing the coated magnet powder with a binder, and compression molding the mixture under heating in the presence of a magnetic field.

12 Claims, 2 Drawing Sheets

METHOD OF PRODUCING SINTERED—OR BOND-RARE EARTH ELEMENT-IRON-BORON MAGNETS

This is a division of Application No. 08/322,559, filed Oct. 13, 1994, U.S. Pat. No. 5,478,409.

FIELD OF THE INVENTION

The present invention relates to a method of producing sintered - or bond- rare earth element-iron-boron magnets superior in magnetic properties.

DESCRIPTION OF THE PRIOR ART

Rare earth element.iron.born permanent magnets are highly praised for the superior magnetic properties. Japanese Patent Publication B-61-34242 discloses a magnetically anisotropic sintered permanent magnet composed of Fe-B-R (R: rare earth element). For the production, an alloy containing the above-mentioned components is cast, the cast alloy is pulverized to an alloy powder, and the alloy powder is molded and sintered. However, the pulverization of cast alloy is a costly step, and the performance of product fluctuates between production batches. Japanese Patent Publication B-3-72124 discloses a production method of an alloy powder for rare earth element.iron.born permanent magnets containing as the main component 8–30 atomic % of R (R is at least one rare earth element including Y), 2–28 atomic % of B and 65–82 atomic % of Fe. The production method comprises steps of reducing the raw material powder composed of a powder of rare earth oxide and a powder of metal and/or alloy with a metallic Ca or $CaH_2$ reducing agent, heating the reduced material in an inert atmosphere, and removing byproducts by leaching with water. Problems accompanied by the method are that steps of removing byproducts and drying are required due to employment of the metallic Ca or $CaH_2$ reducing agent, the alloy powder is readily oxidized by air as the powder is so fine as 1–10 μm, and the oxygen-containing powder brings about inferior magnetic properties in the final product. So, careful handling of the powder product is requested and it necessitates equipments/steps for measuring, mixing and molding thereof under air-insulated conditions, which cause an increase in the production cost.

SUMMARY OF THE INVENTION

It is an object of the present invention to provide a method of producing sintered- or bond- rare earth element.iron.boron magnets obtainable easily and superior in magnetic properties with stable performance.

DETAILED DESCRIPTION OF THE PREFERRED EMBODIMENTS

Figure 1:
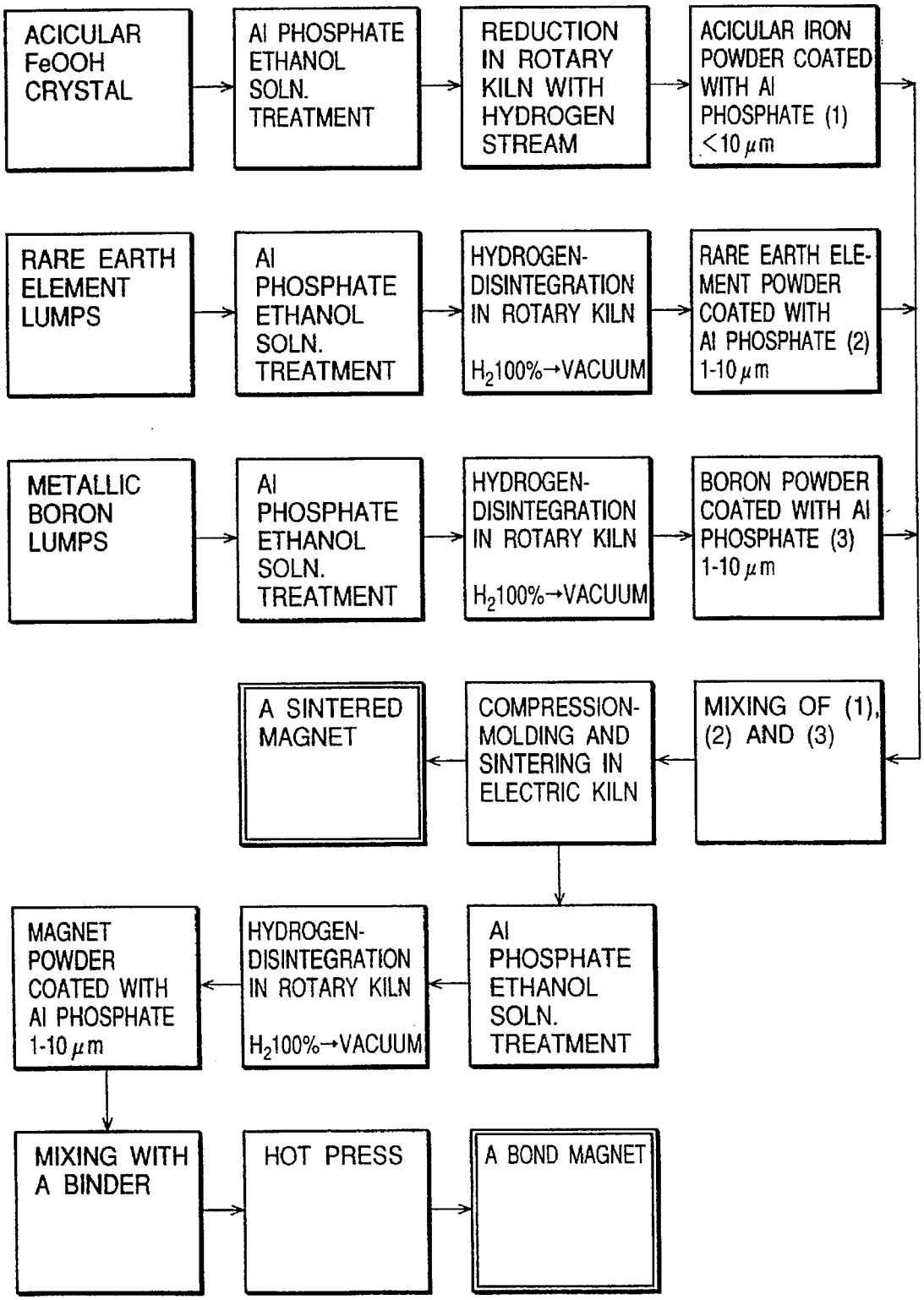
FIG. 1 is a flow chart showing preparation of a sintered magnet and a bond magnet in which aluminum phosphate is used as a heat resistant coating material.

The method of producing sintered rare earth element.iron-.boron magnets according to the present invention is characterized by that it comprises steps of mixing in a scheduled ratio an acicular iron powder coated with a coating material, a rare earth element powder coated with a coating material and a boron powder coated with a coating material, and subjecting the mixture to compression molding followed by sintering of the molded mixture in the presence of a magnetic field.

The method of producing bond rare earth element.iron-.boron magnets according to the present invention is characterized by that it comprises steps of mixing in a scheduled ratio an acicular iron powder coated with a coating material, a rare earth element powder coated with a coating material and a boron powder coated with a coating material, preparing from the mixture a sintered magnet by compression-molding and sintering in the presence of a magnetic field, preparing a magnet powder by hydrogen-disintegration of the magnet wherein a hydrogen-occluded magnet resulted from heating the magnet under hydrogen atmosphere is subjected to hydrogen emission under substantial vacuum to cause disintegration of the hydrogen-occluded magnet, coating the magnet powder with a coating material, mixing the coated magnet powder with a binder, and compression molding the mixture under heating and in the presence of a magnetic field.

A preferable acicular iron powder is obtained by reducing acicular FeOOH (geothite) crystal under hydrogen atmosphere at 300°–500° C., and the length is not longer than 10 μm as exemplified by 1.0 μm in length and 0.1 μm in width. The acicular iron powder is employed for the present invention in a state of being coated with a coating material, and such a heat resistant coating material as aluminum phosphate can coat the acicular iron powder conveniently by reducing a mixture of acicular FeOOH and aluminum phosphate under hydrogen atmosphere to bring about an acicular iron powder coated with aluminum phosphate in a kiln. When such poorly heat resistant coating materials as film-forming synthetic resins like silicone oils and polyvinyl butyral are employed, they are mixed in a state of solution with an acicular iron powder prepared by the reduction of FeOOH, and a coated acicular iron powder is obtained upon drying of the mixture. Since the acicular iron powder taken out of the kiln should not get in touch with air prior to being coated, care must be taken for the equipment and handling. Therefore, heat resistant coating materials like aluminum phosphate are specifically preferred.

As for the rare earth element, such rare earth elements generally used for rare earth element-iron-boron permanent magnets as Nd, Pt, Dy, Ho, Tb, La, Ce, Pm, Sm, Eu, Gd, Er, Tm, Yb, Lu, and Y are mentioned, and one or more than two kinds thereof are employed. Among them, neodymium (Nd) is used preferably. The rare earth element can be employed as alone or as a mixture. In the present invention, selections and mixing ratios of the rare earth element are determined appropriately in accordance with formulations disclosed in the prior art. The rare earth element is preferably pulverized to have an average particle size of around 1–10 μm in order that the particle can diffuse readily during the sintering step. The rare earth element may be pulverized mechanically, however, for the purpose of preventing oxygen effects, it is preferred to adopt a hydrogen-disintegration method in which hydrogen-occluded rare earth element lumps resulted from heating rare earth element lumps under hydrogen atmosphere are subjected to hydrogen emission under substantial vacuum to cause disintegration of the hydrogen-occluded rare earth element lumps. The hydrogen-occluded rare earth element lumps are prepared by heating the lumps at 800°–900° C. under hydrogen atmosphere, and the emission of hydrogen under substantial vacuum is carried out preferably at a temperature not lower than 100° C. If necessary, the hydrogen-disintegration method can be repeated, and rare earth element powder of an average particle size of 1–10 μm can be obtained, and hydrogen occlusion for previously disintegrated lumps can be conducted at a lower temperature like 500° C., as already disintegrated lumps can occlude hydrogen readily. In the present invention, the pulverized rare earth element powder is employed in a state of being coated with a coating material, and such a heat resistant coating material like aluminum phosphate can coat a pulverized rare earth element in a rotary kiln by carrying out the hydrogen-disintegration method for rare earth element lumps added with aluminum phosphate. When such poorly heat resistant coating materials as film-forming synthetic resins like silicone oils or polyvinyl butyral are employed, they are mixed in a state of solution with a rare earth element powder, and a coated rare earth element powder is obtained upon drying of the mixture. Since a rare earth element powder taken out of a kiln should not get in touch with air prior to being coated, care must be taken for the equipment and handling. Therefore, heat resistant coating materials like aluminum phosphate are specifically preferred.

In the present invention, a boron powder employable has preferably an average particle size of 1–10 μm. The boron powder is available similarly to pulverized rare earth elements by the hydrogen-disintegration method. In this case, it is preferred that hydrogen is occluded by boron lumps under hydrogen atmosphere at 800°–900°, and the occluded hydrogen is emitted under substantial vacuum at a temperature not lower than 100° C. If necessary, the hydrogen-disintegration method can be repeated, and boron powder of an average particle size of 1–10 μm can be obtained, and hydrogen occlusion for previously disintegrated lumps can be conducted at a lower temperature like 500° C., as already disintegrated lumps can occlude hydrogen readily. For the coating material, such heat-resistant materials as aluminum phosphate are preferred due to reasons similar to those for the rare earth elements.

As for the coating material, heat resistant materials like aluminum phosphate are especially preferred, as mentioned previously. Aluminum phosphate is available in a powder form, however, it may be used in a form of solution like an ethanolic solution for intimate and uniform adhesion to raw materials for magnet. For the adherence of aluminum phosphate to raw materials for magnet, it can be conducted, for example, by simply adding a 10% ethanolic solution of aluminum phosphate to the raw materials for magnet. Aluminum phosphate remained in the final product affects the magnetic properties not unfavorably but improvably in combination with the oxidation preventing effect. Further, the coating material to be applied on raw materials for magnet may include solutions of such film-forming organic materials as synthetic resins like silicone oils and polyvinylbutyral. Since they decompose at temperatures employed for reduction by hydrogen of FeOOH (300°–500° C.) or those for occlusion of hydrogen by rare earth elements or boron (800°–900° C.), these organic coating materials must be applied to raw materials for magnet already encountered with the heat treatment. This means that though they are applicable to such raw materials as an acicular iron powder and powder of a rare earth element or boron, since these raw materials are readily oxidized by air, precautions for handling and equipments are required and troublesome processing are necessary by comparison with the case of employing aluminum phosphate capable of being applied prior to the heat treatment. The weight ratio of the coating material to a rare earth element powder, a boron powder or an acicular iron powder is 8:1–20:1 respectively.

Thus obtained acicular iron powder coated with a coating material, rare earth element powder coated with a coating material and boron powder coated with a coating material are mixed in a scheduled ratio, and the mixture is compression-molded in the presence of a magnetic field and the molded mixture is sintered in the presence of a magnetic field to obtain a sintered rare earth element.iron.boron magnet.

The mixing ratio of raw materials for magnet is settled arbitrary in accordance with formulations disclosed in the prior art, and the ratio of 20–40 weight % for an rare earth element powder, 0.5–3 weight % for a boron powder and the rest is for the acicular iron powder is appropriate. Other than these raw material components, powders of molybdenum, niobium, etc. may be added for improving temperature characteristics of the magnet, and the powders are preferably coated with a coating material.

The magnetic force, compressing pressure, temperatures or period of time for the sintering step may be determined in accordance with conditions disclosed in the prior art. Sintered rare earth element-iron-boron magnets are obtained usually by sintering under an inert gas atmosphere at 1000°–1200° C. for 1–2 hours. During sintering of materials for magnet mixed in a scheduled ratio, the rare earth element and boron disperse into the acicular iron powder oriented perpendicular to the magnetic field to form an alloy having a specified composition, and a permanent magnet is obtained.

The raw material for the bond magnet is prepared by disintegration of the above-obtained sintered magnet. Since mechanical disintegration may destroy an acicular iron crystal, a hydrogen-disintegration method is employed. According to the hydrogen-disintegration method, a hydrogen-occluded rare earth element resulted from heating the sintered magnet under hydrogen atmosphere is subjected to hydrogen emission under substantial vacuum to cause disintegration of the sintered magnet. The hydrogen-occlusion of rare earth element in the sintered magnet is conducted by heating the magnet at 800°–900° C. under hydrogen atmosphere, and the emission of hydrogen under substantial vacuum is carried out preferably at a temperature not lower than 100° C. If necessary, the hydrogen-disintegration method can be repeated, and magnet powder of an average particle size of 1–10 μm can be obtained, and hydrogen occlusion for previously disintegrated magnets can be conducted at a lower temperature like 500° C., as already disintegrated magnets can occlude hydrogen readily. Sintered magnet to be used as raw materials for the bond magnet is preferably prepared to become softer than a sintered magnet product for the convenience of being subjected to the hydrogen-disintegration method. Since the pulverized sintered magnet is readily oxidized by oxygen in air, it is employed in a state of being coated with a coating material, and such a heat resistant coating material like aluminum phosphate is preferably used due to the same reason as that for rare earth elements. In case of employing aluminum phosphate as the coating material, it is possible to obtain a pulverized sintered magnet coated with aluminum phosphate in a rotary kiln in which lumps of sintered magnet are mixed with aluminum phosphate, heated at 600°–1200° C. under hydrogen atmosphere, and disintegrated by emission of hydrogen occurring under substantial vacuum. When such poorly heat resistant coating materials as film-forming synthetic resins like silicone oils or polyvinyl butyral are employed, they are mixed in a state of solution with a pulverized sintered magnet obtained by the pulverization of lumps of sintered magnet, and a sintered magnet powder coated with the coating material is obtained upon drying of the mixture. The weight ratio of a coating material to the of sintered magnet powder is preferably 8:1–20:1.

Magnetically anisotropic permanent magnets are obtained by mixing the above-mentioned magnet powder coated with a coating material and a binder, and subjecting the mixture to compression molding under heating in the presence of a magnetic field. The existence of magnetic field causes the acicular powder to orient vertically. Conditions for the compression molding are the same as those for preparation of conventional bond permanent magnets. The binder includes polymeric materials like epoxy resins, polyamide resins and vitrification agents like MnO, CuO, $Bi_2O_3$, PbO, $Tl_2O_3$, $Sb_2O_3$, $Fe_2O_3$ and mixture thereof. For the preparation of bond magnets, powders of molybdenum, niobium, etc. may be added together with a binder for improving temperature characteristics of magnets.

FIG. 1 is a flow chart showing preparation of a sintered magnet and a bond magnet in which aluminum phosphate is used as a heat resistant coating material. The first step is for the preparation of an acicular iron powder, in which aluminum phosphate coated acicular FeOOH is reduced in a rotary kiln at 300°–500° C. under hydrogen atmosphere to obtain an acicular iron powder coated with aluminum phosphate (1). The second step is for the preparation of a rare earth element powder, in which aluminum phosphate coated lumps of rare earth element is heated in a rotary kiln at 800°–900° C. under hydrogen atmosphere to occlude hydrogen, subjecting the hydrogen occluded lumps to substantial vacuum to cause emission of hydrogen at temperatures lowered to 100°–300° C. to disintegrate the lump to obtain a rare earth element powder coated with aluminum phosphate (2). The disintegration with hydrogen emission is repeated until the powder has a scheduled particle size. The third step is for the preparation of a boron powder, in which aluminum phosphate coated lumps of boron is heated in a rotary kiln at 800°–900° C. under hydrogen atmosphere to occlude hydrogen, subjecting the hydrogen occluded lumps to substantial vacuum to cause emission of hydrogen at temperatures lowered to 100°–300° C. to disintegrated the lump to obtain a boron powder coated with aluminum phosphate (3). The disintegration with hydrogen emission is repeated until the powder has a scheduled particle size. The fourth step is for the preparation of a sintered magnet, in which the above-mentioned (1), (2) and (3) are mixed in a scheduled ratio, the mixture is compression molded and then the molded material is sintered in the presence of a magnetic field to obtain a sintered rare earth element.iron.boron magnet. The fifth and sixth steps are for the preparation of a bond magnet, in which a sintered magnet obtained similarly to the sintered magnet is coated with aluminum phosphate, the coated magnet is heated in a rotary kiln at 800°–900° C. under hydrogen atmosphere to occlude hydrogen, subjecting the hydrogen occluded magnet to substantial vacuum to cause emission of hydrogen at temperatures lowered to 100°–300° C. to disintegrate the magnet to obtain a magnet powder having a particle size of 1–10 μm. The disintegration with hydrogen emission is repeated until the powder has a scheduled particle size. A mixture of the magnet powder and a binder is compression molded under heating in the presence of a magnetic field to obtain a bond rare earth element.iron.boron magnet.

Figure 2:
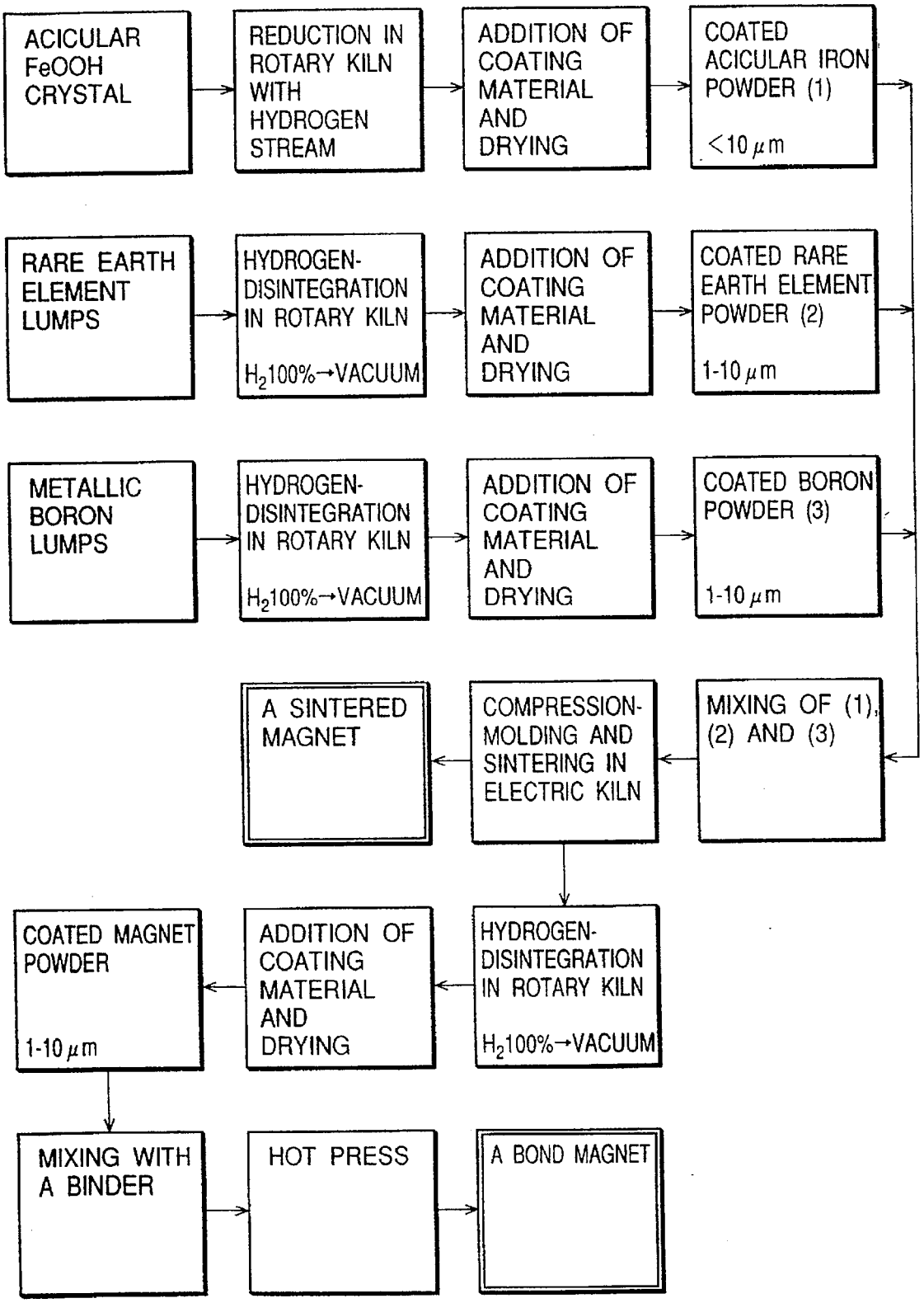
FIG. 2 is a flow chart showing preparation of a sintered magnet and a bond magnet in which a poorly heat-resistant silicone oil or a film forming synthetic resin is used as the coating material.

FIG. 2 is a flow chart showing preparation of a sintered magnet and a bond magnet in which a poorly heat-resistant silicone oil or a film forming synthetic resin is used as the coating material. The steps indicated are the same as those of FIG. 1 with the exception that already pulverized raw materials for magnet including an articular iron powder, a rare earth element powder and a boron powder are coated with the coating material. Although a heat resistant coating material like aluminum phosphate can be employed in this case, its heat resistant characteristics cannot be utilized.

The present invention will be illustrated hereunder by reference to examples, however, the invention never be restricted by the following Examples.

EXAMPLE 1

To an acicular FeOOH (geothite; TITAN KOGYO K.K.) crystal was added a 10% ethanol solution containing aluminum phosphate of an amount corresponding to 5 weight % of the amount of Fe, and the resulted material was mixed and dried. The dried mixture was subjected to reduction for 1 hour in a rotary kiln under ventilation of 10 liter/min of 100 vol % hydrogen gas and at 450° C. (heating up or cooling rate was 5° C./min) to obtain an aluminum phosphate coated acicular iron powder of 0.9 μm length and 0.09 μm width. To a neodymium (Nd) ingot (5 cm×5 cm×5 cm, containing about 20% of Pr and Dy) was added a 10% ethanol solution containing aluminum phosphate of an amount corresponding to 5 weight % of the ingot, and the ethanol was evaporated. The dried Nd ingot was subjected to hydrogen occlusion for 1 hour in a rotary kiln under ventilation of 10 liter/min of 100 vol % hydrogen gas and at 880° C. (heating up rate was 5° C./min), and then was subjected to emission of hydrogen in substantial vacuum during maintaining for 1 hour at the temperature followed by cooling to 200° C. (cooling rate was 5° C./min) to disintegrate the Nd ingot. Three times repetition of the disintegration step resulted in an aluminum phosphate coated Nd powder having an average particle size of 8 μm. To a boron (B) ingot (5 cm×5 cm×5cm) was added a 10% ethanol solution containing aluminum phosphate of an amount corresponding to 5 weight % of the ingot, and the ethanol was evaporated. The dried B ingot was subjected to hydrogen occlusion for 1 hour in a rotary kiln under ventilation of 10 liter/min of 100 vol % hydrogen gas and at 880° C. (heating up rate was 5° C./min), and then was subjected to emission of hydrogen in substantial vacuum during maintaining for 1 hour at the temperature followed by cooling to 200° C. (cooling rate was 5° C./min) to disintegrate the B ingot. Three times repetition of the disintegration step resulted in an aluminum phosphate coated B powder having an average particle size of 8 μm. Thus obtained aluminum phosphate coated Nd powder, aluminum phosphate coated B powder and aluminum phosphate coated acicular iron powder were mixed in a ratio of Nd=28 weight %, B=1 weight % and iron=balance, the mixed powder was compacted under 2t/cm$^2$ pressure in a 5 cm×5 cm×5 cm mold and the molded powder was heated at 1080° C. for 2 hours (heating up rate of 5° C./min) in the presence of a magnetic field of 15 KOe (Oersted) to obtain a sintered magnet. The resulted magnet had the following magnetic properties:

iHc: 9371 Oe

Br: 13560 Gauss

BHmax: 43.4 MGOe

COMPARATIVE EXAMPLE 1

An acicular iron powder, an Nd powder and an boron powder were prepared in the same manner as that for Example 1 except for no coating of aluminum phosphate was conducted to those kinds of powder. A sintered magnet was prepared under the same formulation of components and condition as those for Example 1 in which no specific precaution was taken against shutting down of air. The resulted magnet had the following magnetic properties:

iHc: 8434 Oe

Br: 12204 Gauss

BHmax: 39.0 MGOe

EXAMPLE 2

To a sintered magnet prepared by the same method as that for Example 1 was added a 10% ethanol solution containing aluminum phosphate of an amount corresponding to 5 weight % of the magnet, and the ethanol was evaporated. The dried magnet was subjected to hydrogen occlusion for 1 hour in a rotary kiln under ventilation of 10 liter/min of 100 vol % hydrogen gas and at 880° C. (heating up rate was 5° C./min), and then was subjected to emission of hydrogen in substantial vacuum during maintaining for 1 hour at the temperature followed by cooling to 200° C. (cooling rate was 5° C./min) to disintegrate the magnet. Three times repetition of the disintegration step resulted in an aluminum phosphate coated magnet powder having an average particle size of 8 μm. A mixture of 90 g of the magnet powder and 10 g of an epoxy resin (DAINIPPON INK K.K; for bond magnet) as a binder was charged in a mold and subjected to a magnetic field of 150 Koe, a pressure of 6t/cm$^2$, raising of temperature up to 150° C. at 5° C./min rate and heating for 2 hours at the temperature to obtain a bond magnet. The resulted magnet had the following magnetic properties:

iHc: 15000 Oe

Br: 11760 Gauss

BHmax: 31.9 MGOe

COMPARATIVE EXAMPLE 2

An acicular iron powder, an Nd powder and an boron powder were prepared by the same method as those for Example 1 except for no coating of aluminum phosphate was conducted to those kinds of powder. A sintered magnet was prepared under the same formulation of component and condition as those for Example 1 in which no specific precaution was taken against shutting down of air. A magnet powder was prepared from the sintered magnet in the same manner as that for Example 2 except for no coating of aluminum phosphate was conducted. A bend magnet was prepared from the magnet powder under the same condition as those for Example 2 in which no specific precaution was taken against shutting down of air. The resulted magnet had the following magnetic properties:

iHc: 12000 Oe

Br: 9408 Gauss

BHmax: 25.5 MGOe

By making comparisons of magnetic properties between Example 1 and Comparative Example 1 for the sintered magnet as well as Example 2 and Comparative Example 2 for the bond magnet, the effect of the present invention can be understood clearly.

According to the present invention, it is possible to prepare easily a sintered- or a bond- rare earth element.iron-.boron magnet superior in the magnetic properties with stable performance.

I claim:

1. A method of producing bond rare earth element.iron-.boron magnets which comprises the steps of;

mixing in a scheduled ratio an acicular iron powder coated with a coating material, a rare earth element powder coated with a coating material, and a boron powder coated with a coating material to prepare a powder mixture;

compression-molding the powder mixture to prepare a molded powder mixture;

sintering the molded mixture in the presence of a magnetic field to prepare a sintered magnet;

preparing a magnet powder by hydrogen-disintegration of the sintered magnet wherein a hydrogen-occluded magnet resulting from heating the sintered magnet under hydrogen atmosphere is subjected to emission of the occluded hydrogen under substantial vacuum to cause disintegration of the hydrogen-occluded magnet;

coating the magnet powder with a coating material to prepare a coated magnet powder;

mixing the coated magnet powder with a binder to prepare a mixture of the coated magnet powder and the binder; and compression-molding the mixture under heating in the presence of a magnetic field.

2. A method of producing bond rare earth element.iron-.boron magnets according to claim 1, in which the coating material for the acicular iron powder, rare earth element powder, boron powder and the magnet powder is aluminum phosphate.

3. A method of producing bond rare earth element.iron-.boron magnets according to claim 1, in which the mixing ratio between the rare earth element powder, the boron powder and the acicular iron powder for preparing the powder mixture is 20–40 weight % for the rare earth element powder, 0.5–3 weight % for the boron powder and the balance acicular iron powder.

4. A method of producing bond rare earth element.iron-.boron magnets according to claim 1, in which the acicular iron powder is one prepared by reducing acicular FeOOH (geothite) crystal under heating in hydrogen atmosphere, the rare earth element powder is one prepared by hydrogen-disintegration of rare earth element lumps wherein hydrogen-occluded rare earth element lumps resulting from heating rare earth element lumps under hydrogen atmosphere are subjected to emission of the occluded hydrogen under substantial vacuum to cause disintegration of the hydrogen-occluded rare earth element lumps, and the boron powder is one prepared by hydrogen-disintegration of boron lumps wherein hydrogen-occluded boron lumps resulting from heating boron lumps under hydrogen atmosphere are subjected to emission of the occluded hydrogen under substantial vacuum to cause disintegration of the hydrogen-occluded boron lumps.

5. A method of producing bond rare earth element.iron-.boron magnets according to claim 4, in which the temperature for reducing the acicular iron powder under hydrogen atmosphere is 300°–500° C., the temperature for heating the raw material rare earth element lumps or boron lumps under hydrogen atmosphere to occlude hydrogen is 800°–900° C., and the temperature for emitting hydrogen under substantial vacuum from the hydrogen-occluded rare earth element lumps or boron lumps is not lower than 100° C.

6. A method of producing bond rare earth element.iron-.boron magnets according to claim 2, in which the acicular iron powder coated with aluminum phosphate has a length of not longer than 10 μm, the rare earth element powder coated with aluminum phosphate has an average particle size of 1–10 μm and the boron powder coated with aluminum phosphate has an average particle size of 1–10 μm.

7. A method of producing bond rare earth element.iron-.boron magnets according to claim 1, in which the binder is a vitrifiable agent or an epoxy resin.

8. A method of producing bond rare earth element.iron-.boron magnets which comprises the steps of:

mixing in a scheduled ratio an acicular iron powder coated with aluminum phosphate prepared by reducing acicular FeOOH (geothite) crystal coated with aluminum phosphate under heating in hydrogen atmosphere, a rare earth element powder coated with aluminum phosphate prepared by hydrogen-disintegration of rare earth element lumps coated with aluminum phosphate wherein hydrogen-occluded rare earth element lumps coated with aluminum phosphate resulting from heating rare earth element lumps coated with aluminum phosphate under hydrogen atmosphere are subjected to emission of the occluded hydrogen under substantial vacuum to cause disintegration of the hydrogen-occluded rare earth element lumps coated with aluminum phosphate, and a boron powder coated with aluminum phosphate prepared by hydrogen-disintegration of boron lumps coated with aluminum phosphate wherein hydrogen-occluded boron lumps coated with aluminum phosphate resulting from hearing boron lumps coated with aluminum phosphate under hydrogen atmosphere are subjected to emission of the occluded hydrogen under substantial vacuum to cause disintegration of the hydrogen-occluded boron lumps coated with aluminum phosphate;

preparing a powder mixture from the powders;

compression-molding the powder mixture to prepare a molded powder mixture;

sintering the molded mixture in the presence of magnetic field to prepare a sintered magnet;

coating the sintered magnet with aluminum phosphate to prepare an aluminum phosphate coated magnet;

preparing a magnet powder by hydrogen-disintegration of the aluminum phosphate coated magnet wherein a hydrogen-occluded magnet resulting from heating the aluminum phosphate coated magnet under hydrogen atmosphere is subjected to emission of the occluded hydrogen under substantial vacuum to cause disintegration of the hydrogen-occluded magnet;

mixing the magnet powder with a binder to prepare a mixture of the aluminum phosphate coated magnet powder and the binder; and compression-molding the mixture under heating and in the presence of a magnetic field.

9. A method of producing bond rare earth element.iron-.boron magnets according to claim 8, in which the mixing ratio between the rare earth element powder, the boron powder and the acicular iron powder for preparing the powder mixture is 20–40 weight % for the rare earth element powder, 0.5–3 weight % for the boron powder and the balance acicular iron powder.

10. A method of producing bond rare earth element.iron-.boron magnets according to claim 8, in which the temperature for reducing the acicular iron powder under hydrogen atmosphere is 300°–500° C., the temperature for heating the raw material rare earth element lumps or boron lumps under hydrogen atmosphere to occlude hydrogen is 800°–900° C., and the temperature for emitting hydrogen under substantial vacuum from the hydrogen-occluded rare earth element lumps or boron lumps is not lower than 100° C.

11. A method of producing bond rare earth element.iron-.boron magnets according to claim 8, in which the acicular iron powder coated with aluminum phosphate has a length of not longer than 10 μm, the rare earth element powder coated with aluminum phosphate prepared by hydrogen-disintegration of aluminum phosphate coated rare earth element lumps has an average particle size of 1–10 μm and the boron powder coated with aluminum phosphate prepared by hydrogen-disintegration of aluminum phosphate coated boron lumps has an average particle size of 1–10 μm.

12. A method of producing bond rare earth element.iron-.boron magnets according to claim 8, in which the binder is a vitrifiable agent or an epoxy resin.

* * * * *